US005201649A

United States Patent [19]

Aoki et al.

[11] Patent Number: 5,201,649

[45] Date of Patent: Apr. 13, 1993

[54] PULSE COMBUSTOR

[75] Inventors: Yutaka Aoki, Sapporo; Tadashi Itakura, Ebetu, both of Japan

[73] Assignee: Paloma Kogyo Kabushiki Kaisha, Nagoya, Japan

[21] Appl. No.: 926,902

[22] Filed: Aug. 7, 1992

[30] Foreign Application Priority Data

Aug. 13, 1991 [JP] Japan ..... 3-228828

[51] Int. Cl.[5] ..... F23C 11/04

[52] U.S. Cl. ..... 431/1

[58] Field of Search ..... 431/1

[56] References Cited

U.S. PATENT DOCUMENTS

| | | | |
|---|---|---|---|
| 2,898,978 | 8/1959 | Kitchen | 431/1 |
| 4,080,149 | 3/1978 | Wolfe | 431/1 |
| 4,457,691 | 7/1984 | Hisaoka | 431/1 |
| 4,891,003 | 1/1990 | Ishiguro | 431/1 |

*Primary Examiner*—Carroll B. Dority

*Attorney, Agent, or Firm*—Lahive & Cockfield

[57] ABSTRACT

The present invention provides a simply constructed, improved pulse combustor realizing stable pulse combustion with less noise and vibration. The pulse combustor includes: a combustion chamber; a mixing chamber coupled with the intake side of the combustion chamber via an opening provided with a flame trap; a gas supply conduit connecting to the mixing chamber for supplying fuel gas; and an air duct connecting to the mixing chamber for supplying air. The total volume of the mixing chamber, the gas supply conduit, and the air duct (the total volume V2) is sufficiently greater than the volume of the combustion chamber (the combustion volume V1). Combustion byproducts flown back through the flame trap are diluted with the air/fuel mixture in the mixing chamber and again fed into the combustion chamber for continuous combustion while the reverse pressure is efficiently reduced by the total volume V2.

1 Claim, 3 Drawing Sheets

PULSE COMBUSTOR

BACKGROUND OF THE INVENTION

1. Field of the Invention

The present invention relates to a pulse combustor for continuously combusting mixture of air and fuel gas supplied to a combustion chamber thereof.

2. Description of the Related Art

An example of a conventional pulse combustor for pulsative ignition and continuous combustion of air/fuel mixture is disclosed in Japanese Patent Laying-Open Gazette No. Sho-64-23005. The prior art pulse combustor, as shown in FIG. 3, includes: a nozzle plate NP with plural gas nozzles GN and air nozzles AN; and a resistant plate RP disposed opposite to the nozzle plate NP via a narrow space S. Both the nozzle plate NP and the resistant plate RP are fixed in a combustion chamber R. Rich fuel gas is supplied through a gas conduit GP, the plural gas nozzles GN into the combustion chamber R while air is supplied through the plural air nozzles AN into the combustion chamber R by a fan F. The rich fuel gas and the air are mixed in between the resistant plate RP and the nozzle plate NP and ignited and combusted with spark of an ignition plug SP in the combustion chamber R. Large portion of hot combustion byproducts are exhausted through a tail pipe TP. Although the high explosion pressure in the combustion chamber R tends to cause a back flow of the combustion byproducts to the supply source, the resistant plate RP in the combustion chamber R prevents this undesirable back flow. Exhaustion of the combustion byproducts makes the pressure in the combustion chamber R negative, so that the rich fuel gas and air are again fed into the combustion chamber R and spontaneously ignited and combusted by the residual hot exhausted gas in the combustion chamber R. Ignition and combustion are periodically repeated in the above manner to heat an object like oil in an oil tank.

In the system of the prior art pulse combustor, however, combustion byproducts flown back to the supply source can not efficiently be mixed with the rich fuel gas and air in the combustion chamber R. Relatively high supply pressures of the rich fuel gas and air as well as the resistant plate RP are required to efficiently prevent the back flow of combustion byproducts. More concretely, the pulse combustor requires a high-pressure fan F or a compressor for supplying the high-pressure air and a complicated gas supply unit for supplying the high-pressure fuel gas. These structures unfavorably increase the noise and vibration.

Furthermore, in the prior art system, the fuel gas and air are mixed in the narrow space S between the resistant plate RP and the nozzle plate NP, and this causes non-uniform mixing and thereby unstable combustion.

SUMMARY OF THE INVENTION

The object of the invention is to provide a simply constructed, improved pulse combustor which realizes stable, continuous combustion with less noise and vibration.

The present invention is directed to a pulse combustor for continuous ignition and combustion of air/fuel mixture.

The pulse combustor includes:

a combustion chamber receiving mixture of air and fuel gas for pulsative combustion;

a tail pipe connecting to the combustion chamber for exhausting combustion byproducts from the combustion chamber;

a mixing chamber being coupled with and connected to the combustion chamber via an opening provided with a flame trap, for mixing air and fuel gas and supplying the air/fuel mixture to the combustion chamber;

a gas supply conduit for supplying fuel gas to the mixing chamber;

an air supply conduit for supply air to the mixing chamber; and a fan for feeding air into the air supply conduit.

Here the total volume of the mixing chamber, the gas supply conduit, and the air supply conduit is sufficiently greater than the volume of the combustion chamber.

In the pulse combustor thus constructed, fuel gas and air are respectively supplied to the mixing chamber through the gas supply conduit and the air supply conduit. The mixture of fuel gas and air mixed in the mixing chamber goes through the flame trap to the combustion chamber. When the air/fuel mixture is ignited and combusted in the combustion chamber, for example, with spark of an ignition plug, hot, high-pressure combustion byproducts are largely exhausted through the tail pipe while being partly flown back through the flame trap to the mixing chamber. The back-flown exhausted gas (combustion byproducts) is cooled through the flame trap, and this temperature drop further causes contraction in volume and lowers the pressure of the exhausted gas. The reverse pressure applied to the mixing chamber, the gas supply conduit, and the air supply conduit is sufficiently reduced since the total volume of the mixing chamber, the gas supply conduit, and the air supply conduit is sufficiently larger than the volume of the combustion chamber. The fan used here for supplying air to the mixing chamber thus does not need high pressure or large capacity. Furthermore, the flow of combustion byproducts through the flame trap lowers the explosion pressure in the combustion chamber. These features of the invention allow noise and vibration reduction.

The back-flown combustion byproducts are diluted with the air/fuel mixture in the mixing chamber, and fed into the combustion chamber again for continuous ignition and combustion. The flame trap rectifies the air/fuel mixture to control the ignition point in the combustion chamber, thus allowing stable pulse combustion.

The combustion efficiency is largely affected by the ratio of the total volume in the mixing chamber, the gas supply conduit, and the air supply conduit (hereinafter referred to as the total volume) to the volume in the combustion chamber (hereinafter referred to as the combustion volume). As shown in FIG. 2, the concentration of carbon monoxide (ratio of $CO/CO_2$) varies with the ratio of the total volume V2 to the combustion volume V1. When the total volume V2 is less than the combustion volume V1, the combustion efficiency is lowered. In structure of the invention, the total volume V2 is greater than the combustion volume V1, thus allowing sufficient reduction of the reverse pressure and stable pulse combustion.

These and other objects, features, aspects, and advantages of the present invention will become more apparent from the following detailed description of the preferred embodiment with the accompanying drawings.

DESCRIPTION OF THE PREFERRED EMBODIMENT

Figure 1:
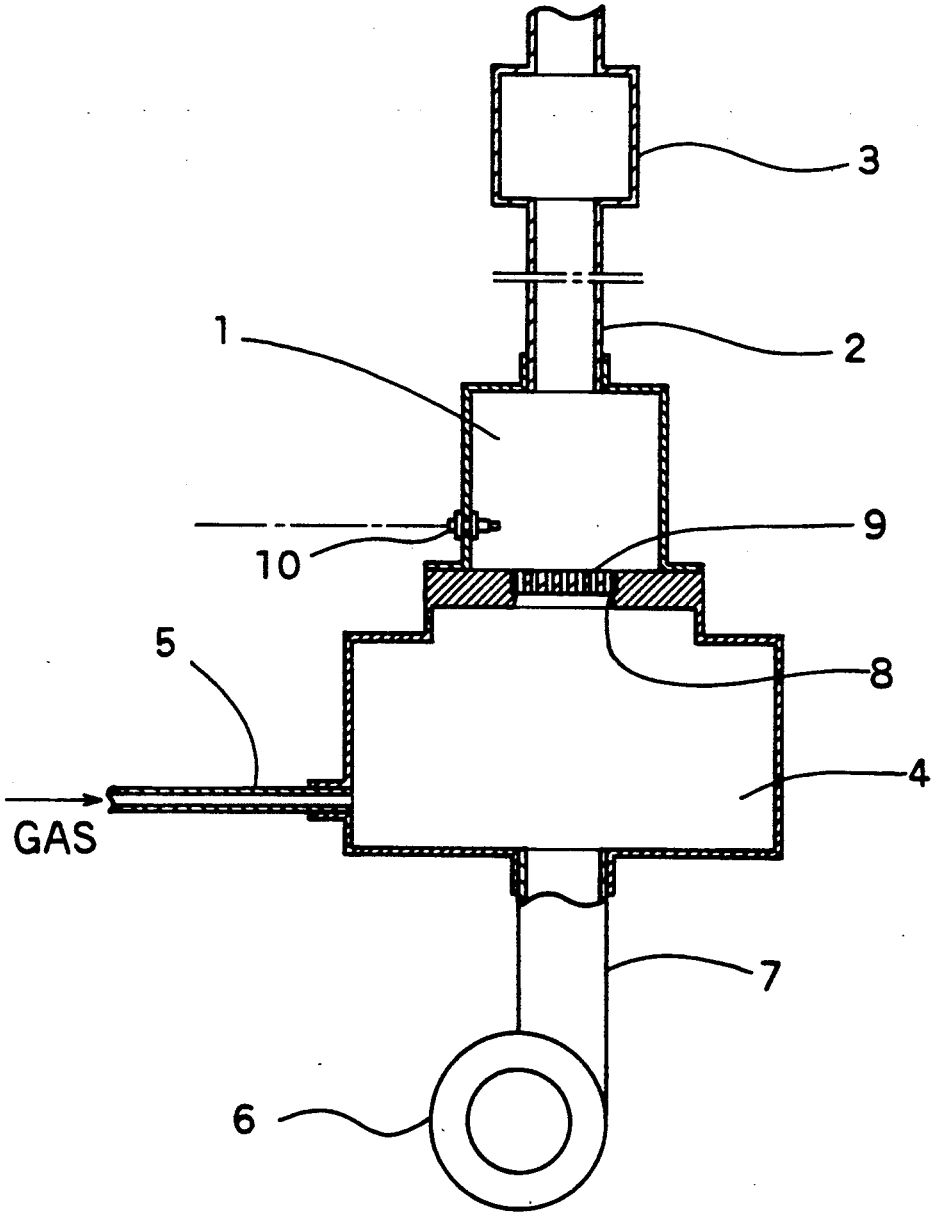
FIG. 1 is a cross sectional view schematically illustrating a pulse combustor as an embodiment of the invention.

FIG. 1 is a cross sectional view schematically illustrating a pulse combustor as an embodiment of the invention. The pulse combustor includes: a cylindrical combustion chamber 1; a tail pipe 2 formed as a conduit of hot exhausted gas; an expansion chamber 3 formed in the middle of the tail pipe 2; a cylindrical mixing chamber 4 coupled with the intake side of the combustion chamber 1; a gas supply conduit 5 for supplying fuel gas to the mixing chamber 4; a fan (multiblade fan in the embodiment) 6 for feeding air; and an air duct 7 for supplying the air fed by the fan 6 to the mixing chamber 4.

The cylindrical combustion chamber 1 and the mixing chamber 4 are concentrically coupled with and connected to each other via an opening 8 formed on the center axis thereof. An ignition plug 10 is fixed to the side wall of the combustion chamber 1 for igniting mixture of air and fuel gas to start combustion. The tail pipe 2 extends from the wall of the combustion chamber 1 opposite to the opening 8. Alternatively, plural tail pipes can be attached to the side wall of the combustion chamber 1.

A flame trap 9 (in the embodiment, the flame trap used has 600 cells (pores)/square inch; diameter of 43 millimeter; and height of 13 millimeter) is fitted into the opening 8.

The air duct 7 connecting the fan 6 to the mixing chamber 4 is attached to the bottom center of the mixing chamber 4, and the gas supply conduit 5 for fuel gas is fixed to the lower portion of the side wall of the mixing chamber 4. The arrangement (position and direction) of the air duct and the gas supply conduit may be changed according to the shape of the mixing chamber to ensure sufficient mixing.

The pulse combustion of the embodiment thus constructed is operated in the following manner.

Fuel gas and air are respectively supplied through the gas supply conduit 5 and the air duct 7 to the mixing chamber 4, and collide with each other to be sufficiently mixed therein. The air/fuel mixture is fed into the combustion chamber 1 through the flame trap 9 fitted into the opening 8 and ignited and combusted by spark of the ignition plug 10 in the combustion chamber 1. Hot, high-pressure combustion byproducts are largely exhausted through the tail pipe 2 by the explosion pressure, while being partly flown back to the mixing chamber 4 through the flame trap 8.

Since an explosive combustion makes the pressure in the combustion chamber 1 negative, the air/fuel mixture is again fed from the mixing chamber 4 to the combustion chamber 1. The air/fuel mixture is spontaneously ignited and combusted by the residual hot combustion byproducts in the combustion chamber 1. In the above manner, the air/fuel mixture is continuously supplied, combusted, and exhausted in the pulse combustor of the embodiment.

The hot, high-pressure exhausted gas (combustion byproducts) flown back to the mixing chamber 4 is cooled through the flame trap 9. The temperature drop further causes contraction in volume and lowers the pressure of the exhausted gas. In the embodiment, the temperature of the exhausted gas was approximately 1,400° C. in the combustion chamber 1 and then lowered through the flame trap 9 to approximately 200° C. in the mixing chamber 4. According to the Charles' law (V/T=constant; V denotes volume, and T denotes temperature), both the volume and pressure of the exhausted gas are reduced to approximately one third in the mixing chamber 4.

The reverse pressure applied to the mixing chamber 4, the gas supply conduit 5, and the air duct 7 is sufficiently reduced since the total volume of the mixing chamber 4, the gas supply conduit 5, and the air duct 7 is much larger than the volume of the combustion chamber 1. In the embodiment, the combustion chamber has the volume of 540 cc, the mixing chamber 4 of 2,000 cc, the gas supply conduit 5 of 24 cc, and the air duct 7 of 136 cc. Namely, the total volume of the mixing chamber 4, the gas supply conduit 5, and the air duct 7 (hereinafter referred to as the total volume V2) is sufficiently larger than the volume of the combustion chamber 1 (hereinafter referred to as the combustion volume V1).

The pulse combustor of the embodiment does not require any high-pressure fan nor the high supply pressure of fuel gas. This structure and sufficient reduction of the explosion pressure in the combustion chamber 1 efficiently reduce the undesirable noise and vibration. In the combustor of the embodiment, the turn-down ratio can be raised by regulating the air capacity of the fan 6 and the amount of fuel gas.

The back-flown combustion byproducts are diluted with the air/fuel mixture in the mixing chamber 4 and fed again into the combustion chamber 1. That is, the back flow of exhausted gas does not hinder the smooth combustion. The flame trap 9 rectifies the air/fuel mixture to control the ignition point in the combustion chamber 1, thus allowing stable pulse combustion.

Figure 2:
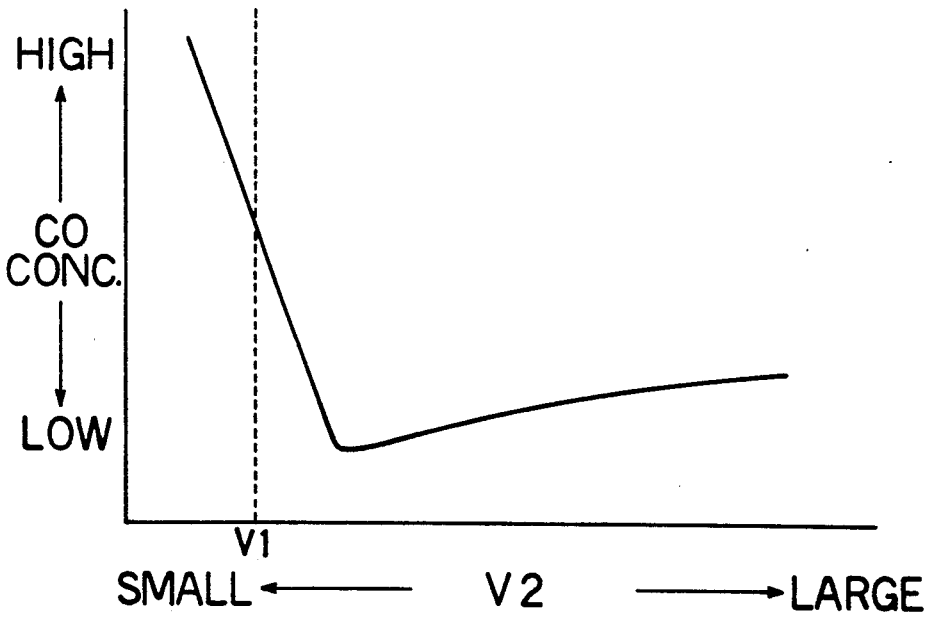
FIG. 2 is a graph showing the combustion efficiency plotted against the ratio of the total volume V2 to the combustion volume V1.
Figure 3:
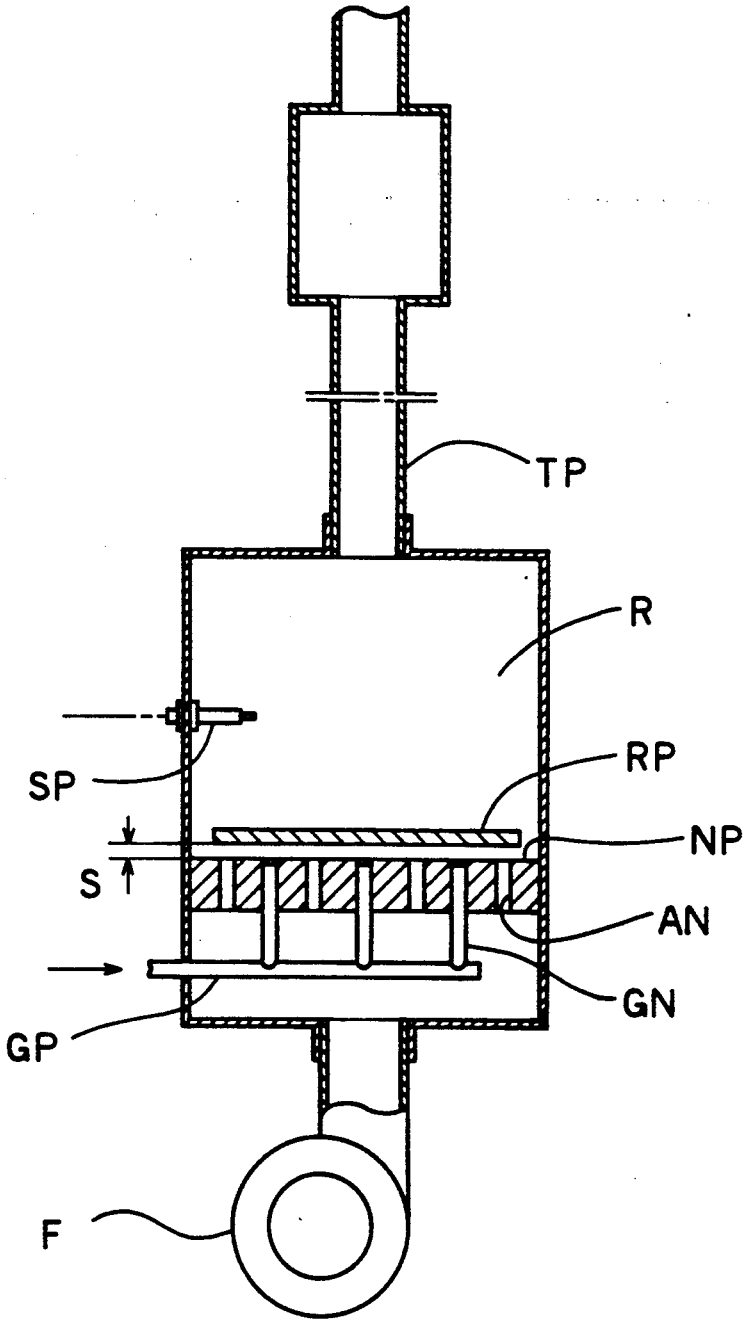
Fig. 3 PRIOR ART
FIG. 3 is a cross sectional view schematically illustrating a conventional pulse combustor.

The combustion efficiency is largely affected by the ratio of the total volume V2 to the combustion volume V1. FIG. 2 shows variation in the concentration of carbon monoxide (ratio of $CO/CO_2$) plotted against the ratio of the total volume V2 to the combustion volume V1. In the range where the total volume V2 is less than the combustion volume V1, the concentration of CO is significantly high, that is, the combustion efficiency is undesirably low. On the contrary, in the range where the total volume V2 is greater than the combustion volume V1, the CO concentration first abruptly decreases and then gradually increases with increase in the ratio of the total volume V2 to the combustion volume V1. In this range, the CO concentration is sufficiently low, that is, the combustion efficiency is preferably high.

The smaller total volume V2 than the combustion volume V1 causes insufficient mixing of the fuel gas and air and undesirably high concentration of the back-flown combustion byproducts diluted with the air/fuel mixture, thus lowering the combustion efficiency. Furthermore, the small total volume V2 does not sufficiently reduce the reverse pressure and requires the larger capacity of the fan 6.

When the total volume V2 is greater than the combustion volume V1, the smaller pressure loss and leaner air/fuel ratio increase the CO concentration only in the allowable range. In the embodiment, the total volume V2 is determined to be sufficiently larger than the combustion volume V1 and to lower the CO concentration to the minimum, thus significantly improving the combustion efficiency.

As described above, the pulse combustor of the invention sufficiently mixes the fuel gas with the air and a small amount of back-flown combustion byproducts in the mixing chamber, thus allowing stable pulse combustion. The pressure of combustion byproducts flown back from the combustion chamber to the mixing chamber is significantly lowered through the flame trap. The mixing chamber, the gas supply conduit, and the air supply conduit greatly reduce the reverse pressure so as to eliminate its adverse effects on gas and air supply sources. The structure of the invention does not require any high-pressure supply unit but efficiently reduces the undesirable noise and vibration.

Since the invention may be embodied in other forms without departing from the scope or spirit of essential characteristics thereof, it is clearly understood that the above embodiment is only illustrative and not restrictive in any sense. The spirit and scope of the present invention is limited only by the terms of the appended claim.

What is claimed is:

1. A pulse combustor for continuous combustion of air/fuel mixture, comprising:

a combustion chamber receiving mixture of air and fuel gas for pulsative combustion;

a tail pipe connecting to said combustion chamber for exhausting combustion byproducts from said combustion chamber;

a mixing chamber being coupled with and connected to said, combustion chamber via an opening provided with a flame trap, for mixing air and fuel gas and supplying the air/fuel mixture to said combustion chamber;

a gas supply conduit for supplying fuel gas to said mixing chamber;

an air supply conduit for supply air to said mixing chamber; and a fan for feeding air into said air supply conduit;

wherein the total volume of the mixing chamber, the gas supply conduit, and the air supply conduit is larger than the volume of the combustion chamber.

* * * * *